US011370103B2

(12) United States Patent
Pham et al.

(10) Patent No.: US 11,370,103 B2
(45) Date of Patent: Jun. 28, 2022

(54) BIT DRIVING TOOL AND DEVICE FOR USE THEREWITH

(71) Applicant: THUNDER INNOVATIONS INC., Calgary (CA)

(72) Inventors: Binh Pham, Cottonwood Heights, UT (US); Alan Kent Farrell, Salt Lake City, UT (US)

(73) Assignee: THUNDERCHUCK INNOVATIONS INC., Calgary (CA)

( * ) Notice: Subject to any disclaimer, the term of this patent is extended or adjusted under 35 U.S.C. 154(b) by 835 days.

(21) Appl. No.: 15/111,338

(22) PCT Filed: Jan. 7, 2015

(86) PCT No.: PCT/CA2015/000005

§ 371 (c)(1),
(2) Date: Jul. 13, 2016

(87) PCT Pub. No.: WO2015/106337

PCT Pub. Date: Jul. 23, 2015

(65) Prior Publication Data

US 2016/0339579 A1 Nov. 24, 2016

Related U.S. Application Data

(60) Provisional application No. 61/928,795, filed on Jan. 17, 2014, provisional application No. 62/057,472, filed on Sep. 30, 2014.

(51) Int. Cl.
*B25F 5/02* (2006.01)
*B25G 1/08* (2006.01)
(Continued)

(52) U.S. Cl.
CPC ..... *B25F 5/029* (2013.01); *B25B 21/00* (2013.01); *B25B 23/0035* (2013.01); *B25B 23/12* (2013.01); *B25G 1/085* (2013.01)

(58) Field of Classification Search
CPC .. B25F 5/029; B25F 1/04; B25F 1/003; B25B 21/00; B25B 23/0035; B25B 23/12; B25B 15/008; B25B 13/56; B25G 1/085
See application file for complete search history.

(56) References Cited

U.S. PATENT DOCUMENTS 632,560 A * 9/1899 Furbish ..... B23B 31/1071 279/82
2,635,661 A * 4/1953 Egan ..... B25F 1/04 81/490

(Continued)

FOREIGN PATENT DOCUMENTS

WO 2005021215 A1 3/2005
WO 2006087638 A2 8/2006

OTHER PUBLICATIONS

International Search Report and Written Opinion dated Apr. 20, 2015 issued in International Patent Application No. PCT/CA2015/000005.

*Primary Examiner* — Hadi Shakeri
(74) *Attorney, Agent, or Firm* — Gugliotta & Gugliotta, LPA

(57) ABSTRACT

A component for a bit driving tool is taught having a mid-chamber telescopically received in an outer chamber, a bit storage chamber formed in the mid-chamber and surrounding and rotatable about a central bore, a central rod axially movable through the central bore when the mid-chamber is telescopically retracted into the outer chamber and a flexible arm comprising a magnetic end, movable into and out of axial alignment with the central bore. Telescopic extension of the mid-chamber out of the outer chamber positions the magnetic end of the flexible arm to magnetically connect with a rear end of a bit stored in the bit storage chamber and telescopic retraction of the component moves the flexible arm and the magnetically connected bit radially (Continued)

into the central bore and wherein further telescope retraction of the component pushes the bit axially through and out of the component. A locking tip for use with a bit driving unit is also taught.

19 Claims, 7 Drawing Sheets

(51) Int. Cl.

| | |
|---|---|
| ***B25B 23/12*** | (2006.01) |
| ***B25B 21/00*** | (2006.01) |
| ***B25B 23/00*** | (2006.01) |

(56) References Cited

U.S. PATENT DOCUMENTS

| | | | | |
|---|---|---|---|---|
| 4,768,405 | A * | 9/1988 | Nickipuck | B25B 15/001 403/325 |
| 5,013,194 | A * | 5/1991 | Wienhold | B23B 31/1071 279/22 |
| 7,086,314 | B2 | 8/2006 | Wannop | |
| 7,156,005 | B2 * | 1/2007 | Cluthe | B25B 23/0035 81/439 |
| 8,250,950 | B2 * | 8/2012 | Cluthe | B25G 1/085 81/177.4 |
| 9,629,640 | B2 * | 4/2017 | Stern | A61B 17/162 |
| 2002/0007705 | A1 * | 1/2002 | Beauchamp | B25G 1/085 81/490 |
| 2014/0310882 | A1 * | 10/2014 | Reynolds | B25G 1/085 7/158 |

* cited by examiner

BIT DRIVING TOOL AND DEVICE FOR USE THEREWITH

CROSS-REFERENCE TO RELATED APPLICATIONS

This application is a 371 National Stage Entry of International Patent Application No. PCT/CA15/000005, filed Jan. 7, 2015, which claims priority and benefit of U.S. Provisional Patent Application No. 61/928,795, filed on Jan. 17, 2014, and U.S. Provisional Patent Application No. 62/057,472, filed on Sep. 30, 2014 the disclosures of which are incorporated herein in their entirety.

FIELD OF THE INVENTION

The present invention relates to a component for a screw driver or drill that allows for ease of bit replacement.

BACKGROUND

Drills and screwdrivers, both powered and manual are well known historically as tools for drilling holes and driving threaded screws into surfaces for any number of construction purposes.

Although some manual screwdrivers and even drills are built with a single, integral screw or drill bit, it is more commonly preferred that the driver or drill be able to accommodate any number of bits, to allow for a variety of sizes of holes to be drilled, or a variety of sizes or types of screws to be driven. Bits are often stored in an external bit storage magazine from which a desired bit can be selected and loaded into the screwdriver or drill chuck. Alternately, many screw drivers comprise a bit storage magazine in the form of a hollow driver handle with multiple chambers for storing the bits. Bits can be selected and removed from the handle end and then loaded into the chuck end of the driver.

The need to first remove and then load bits from an external or integrated magazine often leads to loss of bits and additional time.

Some prior art drills and screwdrivers have been designed in which bits may be stored in chamber that is integral with the tool, and in which bits may be selected and then pushed through chamber and out through the chuck where it is locked or otherwise prevented from rotating inside or sliding out of the chuck.

However in most such cases, the bit storage chamber is mis-aligned with the central chamber and chuck of the tool. In such cases, bit selection is performed by rotating the bit storage chamber until the desired bit aligns with an opening leading to the central chamber, and then the bit is pushed through the opening, into the chamber and out through the chuck. The arrangement is not unlike a bullet chamber in relation to the barrel of a gun.

U.S. Pat. No. 7,086,314 teaches a tool with a bit storage chamber that is rotatable about a slotted, apertured core of the tool. The tool comprises a lever arm pivotally coupled to a core to magnetically attract the desired bit from the chamber and a magnet-tipped push rod to push the bit through a shaft to protrude through the chuck. The magnetic lever arm shares a limited area of contact with bit and is thus limited to the size of bits that can be magnetically attracted and pulled into the core.

A need and interest therefore exists in the art to develop improved drill and screwdriver assemblies of simple internal design that allow for rapid changing of bits.

SUMMARY

A component for a bit driving tool is taught. The component comprises a mid-chamber, telescopically received in an outer chamber, the mid-chamber and the outer chamber surrounding a central bore, a bit storage chamber formed in the mid-chamber, surrounding and rotatable about the central bore and comprising one or more bit storage compartments, a central rod extending through and out of the outer chamber, said central rod being axially movable through central bore when the mid-chamber is telescopically retracted into the outer chamber and a flexible arm comprising a magnetic end, movable into and out of axial alignment with the central bore. Telescopic extension of the mid-chamber out of the outer chamber positions the magnetic end of the flexible arm to magnetically connect with a rear end of a bit stored in the bit storage chamber and telescopic retraction of the component moves the flexible arm, with the magnetic end and the magnetically connected bit, radially inwardly into the central bore and wherein further telescope retraction of the component pushes the central rod, the flexible arm, the magnetic end and the bit axially through the central bore until the bit extends out of the component.

A locking tip for use with a bit driving unit is taught. The locking tip comprises an inner locking sleeve defining an inner bore for receiving a bit, an outer locking sleeve slidably received over the inner locking sleeve and one or more bearings provided on an inner surface of the inner locking sleeve for gripping the bit. The outer locking sleeve is slidable along the inner locking sleeve from a closed position in which the one or more bearings are tightened to grip the bit, and an open position in which the one or more bearings are loosened release grip on the bit.

BRIEF DESCRIPTION OF THE DRAWINGS

The present invention will now be described in greater detail, with reference to the following drawings, in which.

DESCRIPTION OF THE INVENTION

The invention provides an insert or internal component for a screwdriver or drill. The component houses screw bits or drill bits that can be changed without the need to individually remove and load the bits into the tool opening. Changing of bits can be performed with the component installed in the screwdriver or drill.

The component is rotatably received in the screwdriver or drill. More preferably, rotation of the component is accommodated by a series of ball bearings between the rotating component and the stationary outer drill body. When the component is in an open position, it can freely move or spin. When the component is moved to a closed position, it is locked against spinning unless the drill is activated.

The term drill is used in the context of the present invention to generally describe any manual or powered tool used to drill holes or drive screws or other fasteners. For the purposes of the present invention the term drill is intended to encompass any such device that can handle standard fastener bits. The bits of the present invention can be drill bits or screwdriver bits, depending on the applications. Any number of sizes or shapes of such bits can be used with the component tool of the present invention. Most preferably the bits are 2" bits. Shorter or longer bits can also be accommodated.

Figure 1:
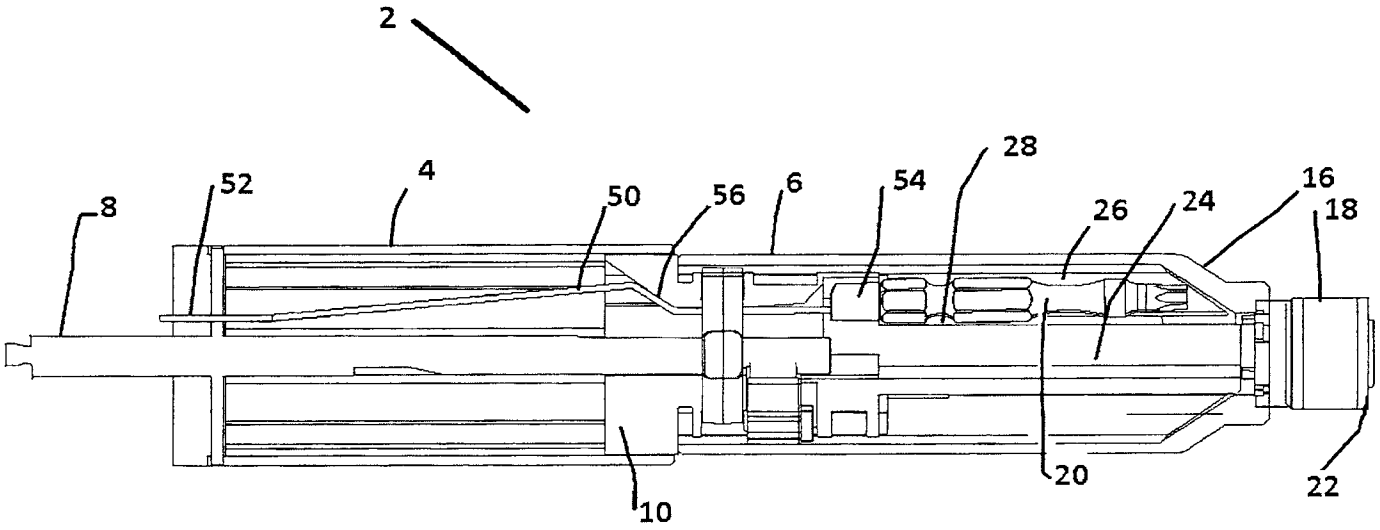
FIG. 1 is a cross sectional view of the component of the present invention in an opened position.
Figure 2:
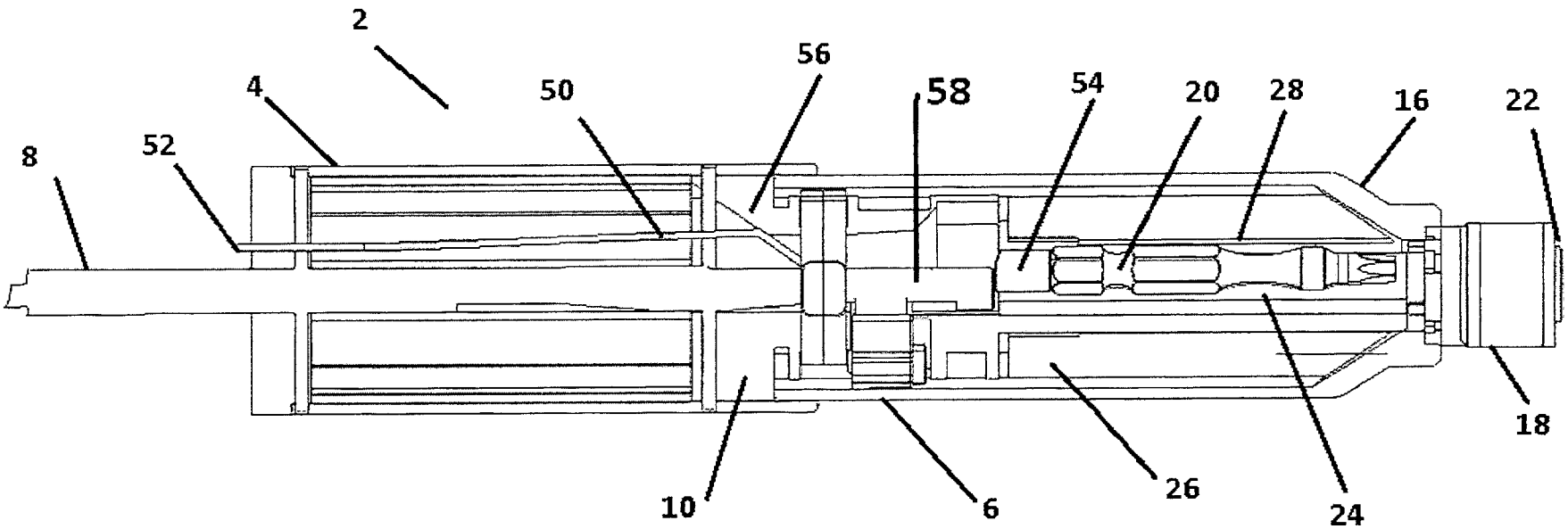
FIG. 2 is a cross sectional view of the component of the present invention in a bit engaging position.
Figure 3:
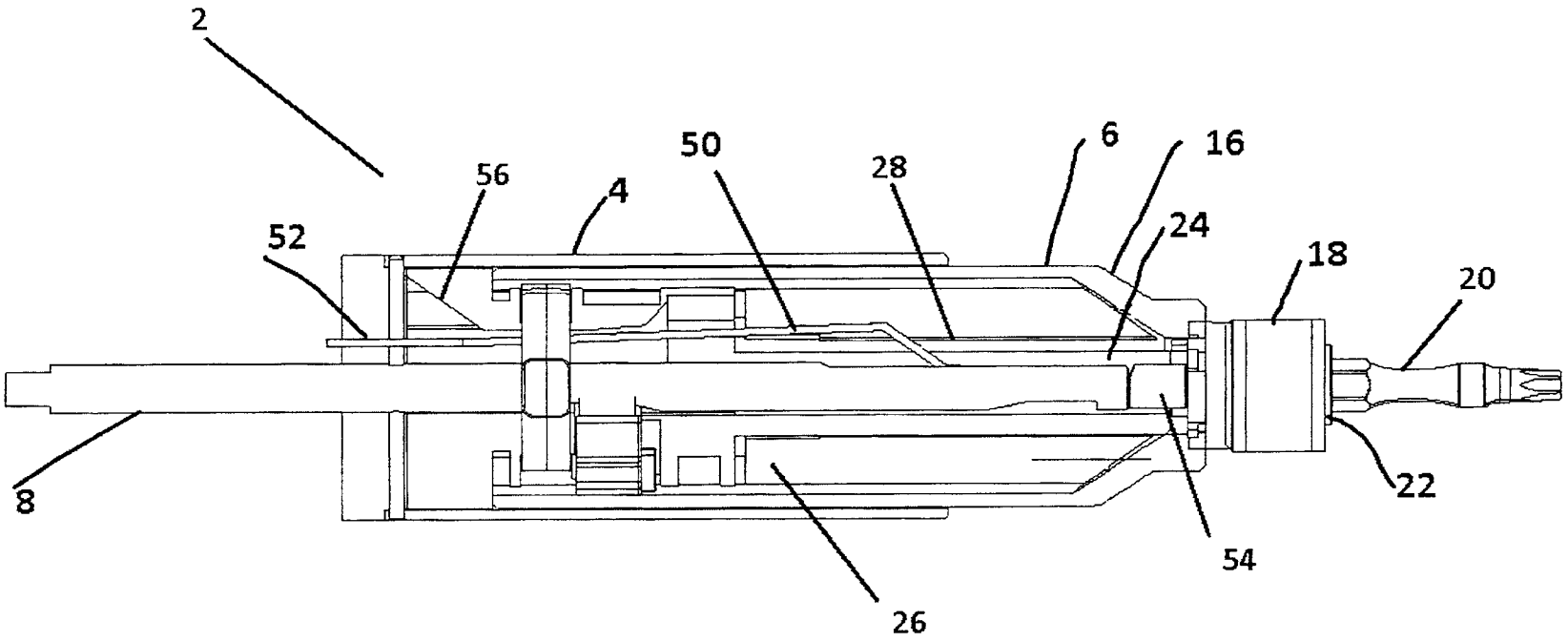
FIG. 3 is a cross sectional view of the component of the present invention in a closed position.

The component of the present invention is shown in FIGS. 1 to 3 in various positions. With reference to these figures, the component 2 comprises a mid-chamber 6 having first end that is telescopically received into a second end of an outer chamber 4. When the mid-chamber 6 is extended out of the outer chamber 14, it is rotatable. When the mid-chamber 6 is pushed into the outer chamber it is locked against independent rotation. Any number of known means may be employed to prevent relative rotation between the mid-chamber and the outer chamber 4, including complimentary profiles on an inner surface of the outer chamber 4 and the on an outer surface of the mid-chamber 6 that interact to prevent relative rotation. Such profiles can include but are not limited to complimentary ribs and slots, ridges and valleys, or complimentary faceted surfaces.

An inner chamber 10 sits inside both the mid-chamber 6 and the outer chamber 4. The inner chamber does not rotate with the mid-chamber and is rotationally locked together with the outer chamber 4.

A central rod 8 extends through a central bore 24 of the component 2 from the inner chamber 10 to the outer chamber 4 and extends out of and is rotationally locked to the first end of the outer chamber 4. The portion of the central rod 8 that extends from the first end of the outer chamber 4 is connectable to a drill or other drive means to rotate the central rod 8 and thus cause rotation of the outer chamber 4, inner chamber 10 and mid-chamber 6 when a bit has been engaged, the position shown in FIG. 3.

A locking tip 18 extends from a second end of the mid-chamber 6 to receive bits 20. The locking tip 18 can receive bits 20 that are pushed through the mid-chamber 6 or which are loaded, manually or otherwise, into a first end 22 of the locking tip 18.

The mid-chamber 6 comprises a bit storage chamber 26 that circumferentially surrounds the inner chamber 10 and a central bore 24 of the component 2. The bit storage chamber 26 comprises one or more spaces for housing one or more bits 20. Rotation of the mid-chamber 6 rotates the bit storage chamber 26 around the central bore 24 for selection of a desired bit 20. A longitudinal slot 28 in the central bore 24 allows for passage of a desired bit 20 from the bit storage chamber 26 into the central bore 24.

The second end of the mid-chamber 6 preferably comprises an angled profile 16 that assists in guiding bits 20 into the radial center of the component 2 and out of the locking tip 18.

The inner chamber 10 further comprises a flexible arm 50 that is fixed to the outer chamber 4, preferably at a first end 52 of the flexible arm 50, although other points of attachment may be possible and are also encompassed by the scope of the present invention. The flexible arm 50 further comprises a magnetic end 54 that is aligned with the longitudinal slot 28 of bit storage chamber 26. The magnetic end 54 may be connected to the flexible arm 50 by any suitable means known in the art and may or may not be integral to the flexible arm 50. The connection of the magnetic end 54 to the flexible arm 50 may be a rigid connection, semi-flexible connection, flexible connection or a pivotable connection.

The flexible arm of the present invention may be composed of any material that is known to provide elastic deformation and includes, but is not limited to metals, alloys, plastics and composites. More preferably, the flexible arm is composed of materials generally categorized as shape memory materials, memory materials or smart materials. That is, the flexible arm 50 of the present invention preferably has the property that it can be bent or deformed to a significant degree and still return to its original shape when released.

With reference to FIG. 1, to load a bit 20, the mid-chamber 6 is telescopically extended from the outer chamber 4, thereby allowing rotation of the mid-chamber 6, independent of the outer chamber 4 and the inner chamber 10. Bit selection is made by rotation of the mid-chamber 6, thereby rotating the bit storage chamber 26 about the central bore 24 until the desired bit 20 aligns with slot 28.

Preferably the component 2 of the present invention comprises means for the user to identify and select a bit 20 of choice. In one embodiment, the mid-chamber 6 can be made of a transparent or translucent material that allows visual identification of the bits within the bit storage chamber 26. In another embodiment, an audio, visual or tactile means can be used to confirm alignment of the desired bit 20 with the slot 28. For example, a detent can be incorporated into mid-chamber 6 that provides a tactile or audio 'click' or 'snap' each time a bit storage space is aligned with the slot 28. It would be well understood by a person of skill in the art that any number of means can possibly be used to identify a desired bit or to confirm alignment of said bit 20 with slot 28.

In a further preferred embodiment, mid-chamber 6 can be a removable piece of the present invention, allowing for different mid-chambers, each having its own bit storage chamber with one or more bits, to be loaded into to drill component 2 in order to provide different bits for use with the present invention.

The magnet end 54 of the flexible arm 50 aligns with the bit storage chamber 26. Preferably, the flexible arm 50 biases the magnetic end 54 radially outwardly towards the bit storage chamber 26 rather than inwardly towards the central bore 24. The shape memory quality of the flexible arm 50 returns the flexible arm 50 to the preferred position whenever any deformation applied to the flexible arm 50 is released. In a most preferred embodiment, the flexible arm 50 is biased at a 7° angle from the central bore.

Figure 6:
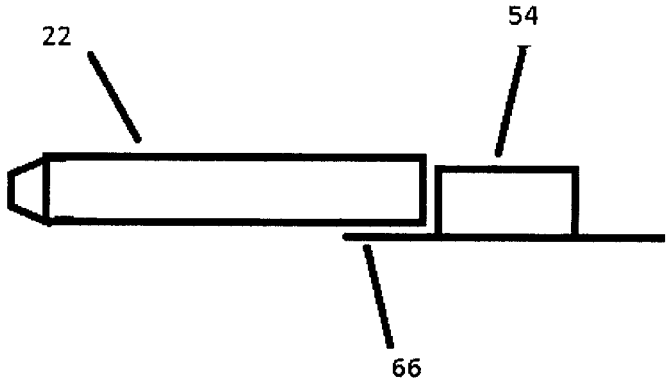
FIG. 6 is a side view of one embodiment of the magnetic end of the present invention.
Figure 7:
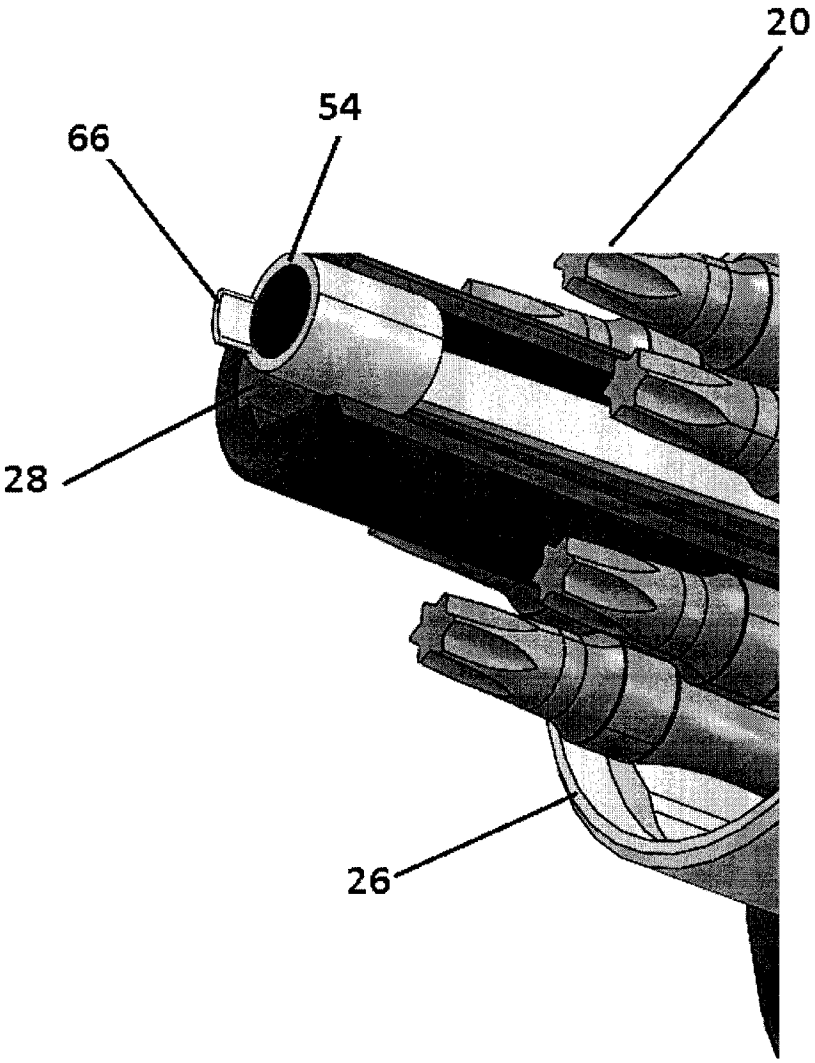
FIG. 7 is a perspective view of one embodiment of the magnetic end of the present invention.

When the desired bit is aligned with the slot 28, the magnetic end 54 of the flexible arm 50 becomes magnetically attracted to a proximal end of the bit 20 and thereby catches the bit 20. In a further preferred embodiment, as illustrated in FIGS. 6 and 7, the magnetic end 54 may optionally include a protrusion 66 that may serve to further mechanically engage the bit 20, in addition to the magnetic engagement provided by the magnetic end 54.

The mid-chamber 6 can then be retracted into outer sleeve 4. A first stage of this retraction is shown in FIG. 2, which illustrates an engaged position of the component 2 of the present invention. In the engaged position, at least a part of the mid-chamber 6 and the inner chamber 10 are retracted into the outer chamber 4. An angled profile 56 is preferably formed in the inner chamber 10 and retraction of the inner chamber 10 into the outer chamber 4 causes flexible arm 50 to travels along the profile 56, thereby overcoming the biasing tendency of flexible arm 50 and causing the flexible arm 50 move radially inwardly into alignment with the central bore 24, along with its magnetic end 54 and the bit 20 magnetically attracted thereto. The bit 20 is thereby pulled through slot 28 and into central bore 24. The optional protrusion 66 on the magnetic end 20 may preferably serve to assist in engaging and guiding the bit 20 through the central bore 24.

Retraction of the mid-chamber 6 and inner chamber 10 also forces the central rod 8 to travel axially in the direction of the locking tip 18. To accommodate both the axially progressing central rod 8 and the flexible arm 50, an axial groove 58 is preferably formed in the central rod 8 that accommodates the flexible arm 50. While a groove 58 is a most preferred embodiment, it would be well understood by a person of skill in the art that any number of means can be provided for accommodating both the central rod 8 and the flexible arm 50 in the central bore 24, including any number of shapes and configurations of both the central rod 8 or the flexible arm 50 or both.

As the mid-chamber 6 is retracted into the outer chamber 4, an end of the central rod 8 abuts against the magnetic tip 54 continues to travel axially into central bore 24, thereby pushing flexible arm 50 with the bit 20 magnetically linked to the magnetic end 54, through the central bore 24. In this way, the central rod 8 advantageously aids in pushing the bit 20 into the locking tip 18 while also reducing axial forces experienced by the flexible arm, 50 which is by nature more pliant and liable to bend under axially pushing forces.

The component 2 is illustrated in its fully engaged position in FIG. 3, in which the bit 20 has been pushed through the central bore 24 and out to the locking tip 18, from which the bit 20 protrudes.

In use, the central rod 8 is connected into a drill or similar driver device. Rotational force powered by the driver device is transmitted to the central rod 8. The central rod 8 is rotationally fixed to the outer chamber 4, which is in turn rotationally fixed to the inner chamber 10 and to mid-chamber 6. The mid-chamber 6 is further rotationally fixed to the locking tip 18, which is rotationally fixed to the bit 20, thereby serving to transmit rotational force from the driver device to the bit 20 and effect drilling or fastening as needed.

A bit 20 can also be retracted from the locking tip 18 and returned to its space in the bit storage chamber 26 by reversing the method described above. Namely, the mid-chamber 6 is protracted out of the outer chamber 4, thereby retracting the central rod 8, flexible arm 50, magnetic end 54 and bit 20 back through the central bore 24. As the flexible arm 50 moves back over profile 56, the shape memory tendency of the flexible arm 50 causes the flexible arm 50 to return to its originally position. The magnetic end 54, still magnetically linked to the bit 20, moves the bit 20 from the central bore 24 through slot 28 and back to its space in the bit storage chamber 26.

Figure 4:
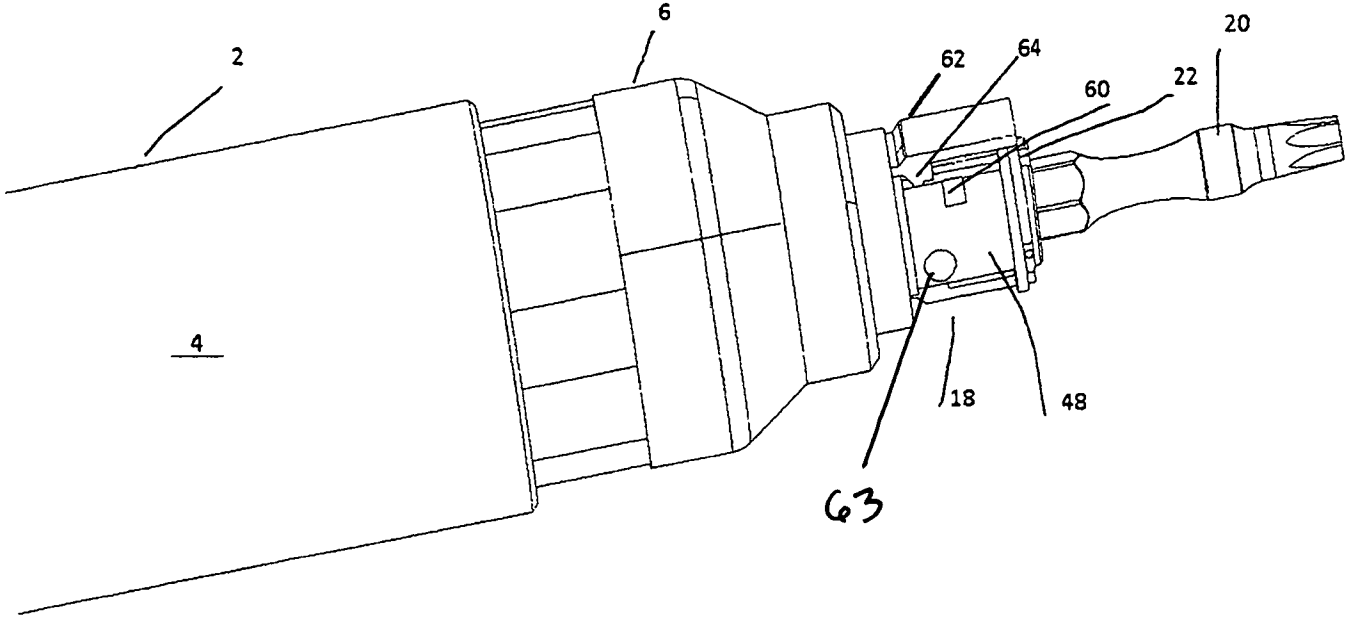
FIG. 4 is a detailed cross sectional view of the locking tip shown in a closed position in which the bit is locked in the locking tip.
Figure 5:
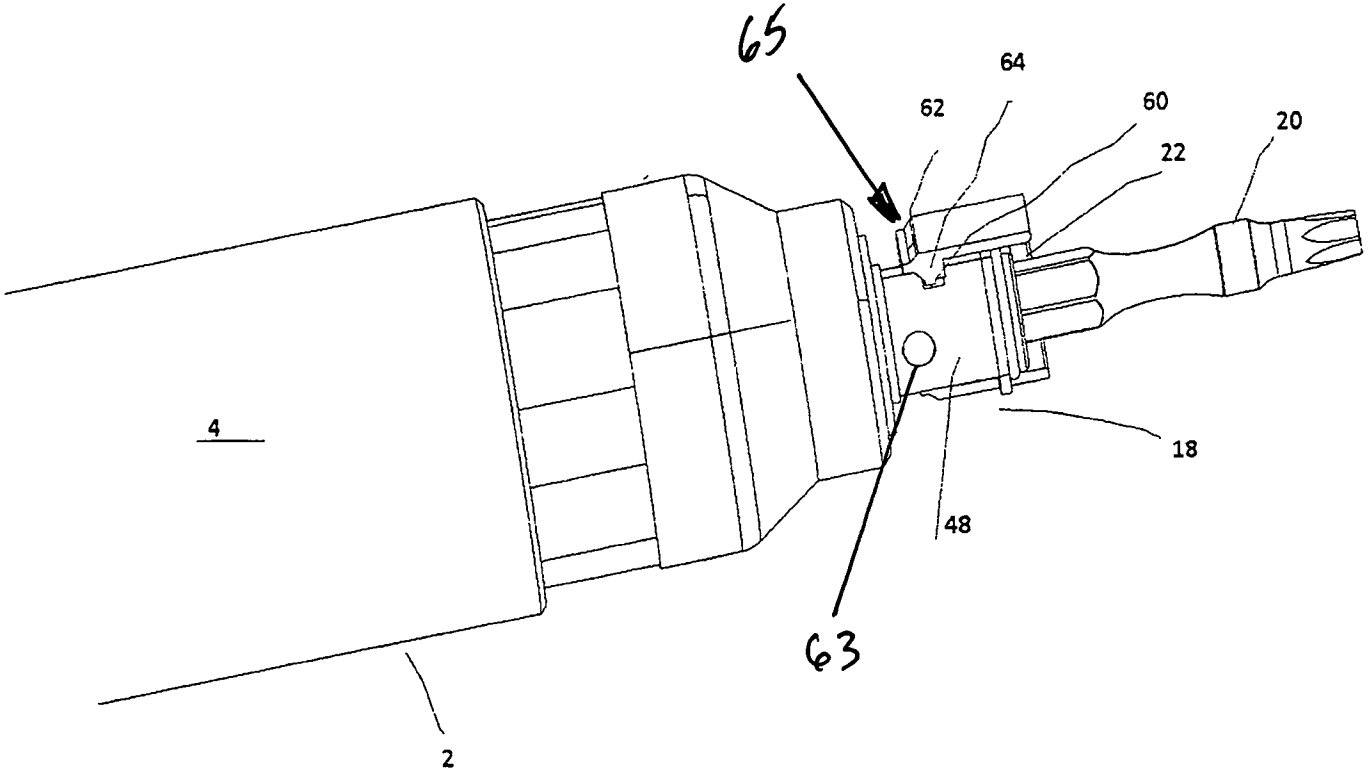
FIG. 5 is a detailed cross sectional view of the locking tip shown in an open position in which the bit is locked in the locking tip.

The locking tip 18 is illustrated in more detail in FIGS. 4 and 5. The locking tip 18 preferrably comprises locking means for preventing the bit from rotating within the locking tip 18 or from falling out of the locking tip 18. The locking mechanism preferrably comprises an inner locking sleeve 48 having an inner bore through which the bit 20 passes and more preferrably having one or more notches 60 formed on an outer surface thereof. An outer locking sleeve 62 is slidably received over the inner locking sleeve 48 and more preferrably comprises one or more projections 64 formed on an inner surface thereof. The outer locking sleeve 62 moves from a closed position, depicted in FIG. 4, to an open position, depicted in FIG. 5. In the closed position, the outer locking sleeve 62 is adjacent the mid-chamber 6, in turn engaging one or more bearing 63 in the locking tip 18 to grip the bit 20. In the open position, the outer locking sleeve 62 is outwardly biased 65 from the mid-chamber 6, in turn loosening disengaging said same bearings 63 around the bit 20, thereby allowing bits to be loaded into the locking tip 18 from the bit storage chamber 26, or for bits to be retraced back into the bit storage chamber 26.

In a more preferred embodiment, the locking tip 18 comprises one or more biasing means, preferably but not limited to a spring that bias the outer locking sleeve 62 into the closed position, to advantageously ensure that the locking tip 18 defaults to a position that grips the bit 20. To overcome this bias, the outer locking sleeve 62 may preferably be pulled away from the mid-chamber 6 and is also rotatable around the inner locking sleeve 48 until the one or more projections 64 are received in the one or more notches 60, to thereby hold the locking tip 18 in the open position for bit loading and unloading.

It is also possible to load bits into the locking tip 18 from sources other than the bit storage chamber 26. Bits 20 can also be loaded into the first end 22 of the locking tip 18, in which case the same locking means cooperate to hold the bit 20 from falling out. This method of loading advantageously allows the present component 2 to be used with a variety of bits 20 beyond those stored in the component 2.

The present invention can thereby accommodate bits in the locking tip 18 which may be significantly larger than those that can be accommodated in the bit storage chamber 26. Preferably the bit storage chamber 26 accommodates bits 20 of up to a 2" size, whereas bits of sizes ranging from 2" up to 4" can be inserted from outside into the locking tip 18.

The bit storage chamber 26 of the present invention can advantageously be emptied and filled by the user, to load the component 2 with a desired magazine of bit types and sizes. To empty spaces in the bit storage chamber 26, the user simply loads bits 20 through the locking tip 18, as described above, and pulls the bits 20 out through end 22 of the locking tip 18 to empty the bit storage chamber 26. Then new bits 20 can be inserted into the locking tip 18 from end 22 and the component 2 can be protracted to its open position to pull the bits 20 back into the bit storage chamber 26.

In the foregoing specification, the invention has been described with a specific embodiment thereof; however, it will be evident that various modifications and changes may be made thereto without departing from the broader scope of the invention.

The invention claimed is:

1. A bit driving tool comprising:

a. a mid-chamber, telescopically received in an outer chamber, the mid-chamber and the outer chamber surrounding a central bore;

b. a bit storage chamber formed in the mid-chamber, surrounding and rotatable about the central bore and comprising one or more bit storage compartments;

c. a central rod extending through and out of the outer chamber, said central rod being axially movable through central bore when the mid-chamber is telescopically retracted into the outer chamber; and d. a flexible arm comprising a magnetic end, movable into and out of axial alignment with the central bore;

wherein telescopic extension of the mid-chamber out of the outer chamber positions the magnetic end of the flexible arm to magnetically connect with a rear end of a bit stored in the bit storage chamber and telescopic retraction of the component moves the flexible arm, with the magnetic end and the magnetically connected bit, radially inwardly into the central bore and wherein further telescope retraction of the component pushes the central rod, the flexible arm, the magnetic end and the bit axially through the central bore until the bit extends to and out of a locking tip attached to the mid-chamber, from which the bit extends when the mid-chamber is retracted into the outer chamber, said locking tip comprising:

a. an inner locking sleeve defining an inner bore for receiving the bit in a position fixed relative to said inner locking sleeve;
b. an outer locking sleeve slidably received over the inner locking sleeve; and
c. one or more bearings provided on an inner surface of the inner locking sleeve for gripping the outer locking sleeve, wherein the outer locking sleeve is slidable along the inner locking sleeve from a closed position in which the one or more bearings are engaged to grip the outer locking sleeve, and an open position in which the one or more bearings are loosened release grip on the outer locking sleeve.

2. The bit driving tool of claim 1, wherein telescopic extraction of the mid-chamber out of the outer chamber retracts the central rod, the flexible arm, the magnetic end and the bit axially through the central bore and moves the flexible arm and the magnetically connected bit radially outwardly from the central bore into a compartment of the bit storage chamber.

3. The bit driving tool of claim 1, wherein said flexible arm is biased radially outwardly towards the bit storage chamber by a biasing means.

4. The bit driving tool of claim 1, wherein the flexible arm is biased radially outwardly towards the bit storage chamber by being formed of a shape memory material.

5. The bit driving tool of claim 3, further comprising an angled guide formed adjacent the flexible arm and wherein axial travel of the flexible arm through the central bore guides the flexible arm along said angled guide to overcome its radial outward bias and pivot radially inwardly into the central chamber.

6. The bit driving tool of claim 1, wherein the central rod accommodates the flexible arm to allow both the central rod and the flexible arm to enter and be radially centered within the central bore.

7. The bit driving tool of claim 6, wherein the central rod comprises an axial groove formed in the central rod to accommodates the flexible arm.

8. The bit driving tool of claim 1, wherein mid-chamber is rotatable when protracted out of the outer chamber.

9. The bit driving tool of claim 8, wherein rotation of the mid-chamber serves to align a selected bit, stored in a compartment of the bit storage chamber, with the flexible arm.

10. The bit driving tool of claim 9, wherein mid-chamber comprises identifying indicia for identifying bits.

11. The bit driving tool of claim 9, wherein the the mid-chamber is transparent for facilitating identifying bits.

12. The bit driving tool of claim 10, wherein the identifying indicia comprise a detent formed between the bit storage chamber and the mid-chamber.

13. The bit driving tool of claim 1, wherein the mid-chamber is removable from the outer chamber.

14. The bit driving tool of claim 1, wherein the locking tip further comprises:

a. an inner locking sleeve defining an inner bore for receiving the bit in a position fixed relative to said inner locking sleeve;
b. an outer locking sleeve slidably received over the inner locking sleeve; and
c. one or more bearings provided on an inner surface of the inner locking sleeve for gripping the outer locking sleeve, wherein the outer locking sleeve is slidable along the inner locking sleeve from a closed position in which the one or more bearings are engaged to grip the outer locking sleeve, and an open position in which the one or more bearings are loosened release grip on the outer locking sleeve.

15. The bit driving tool of claim 14, further comprising the outer locking sleeve comprising one or more projections formed on an inner surface thereof and the inner locking sleeve comprises one or more notches formed on an outer surface thereof and wherein the outer locking sleeve is rotatable about the inner locking sleeve in the open position, such that the one or more projections are received in the one or more notches, to thereby overcome biasing forces and hold the locking tip in the open position for bit loading and unloading.

16. The bit driving tool of claim 15, wherein bits are removable from the locking tip.

17. The bit driving tool of claim 15, wherein bits are insertable into the locking tip.

18. The bit driving tool of claim 1, further comprising a protrusion on said magnetic end that mechanically engages the bit.

19. The bit driving tool of claim 1, further comprising an angled guide formed adjacent the flexible arm and wherein axial travel of the flexible arm through the central bore guides the flexible arm along said angled guide to overcome its radial outward bias and pivot radially inwardly into the central chamber.

* * * * *